US005946903A

United States Patent [19]

Marquard

[11] Patent Number: 5,946,903

[45] Date of Patent: Sep. 7, 1999

[54] INTERNAL COMBUSTION ENGINE HAVING A SEPARATE ROTARY COMBUSTION CHAMBER

[76] Inventor: Michael Mason Marquard, 812 Oaktree Rd., Kennett Square, Pa. 19348

[21] Appl. No.: 08/834,759

[22] Filed: Apr. 3, 1997

[51] Int. Cl.[6] ..... F02G 3/02

[52] U.S. Cl. ..... 60/39.6; 418/265; 418/269

[58] Field of Search ..... 60/39.6; 123/68; 418/265, 269

[56] References Cited

U.S. PATENT DOCUMENTS

| | | | |
|---|---|---|---|
| 1,004,696 | 10/1911 | Schoeck . | |
| 3,811,271 | 5/1974 | Sprain | 60/39.6 |
| 3,921,595 | 11/1975 | Saunders . | |
| 3,931,807 | 1/1976 | Bloom . | |
| 3,932,987 | 1/1976 | Munzinger . | |
| 4,230,075 | 10/1980 | Lowther | 123/68 |
| 4,241,713 | 12/1980 | Crutchfield | 123/202 |
| 4,646,693 | 3/1987 | Fayngersh et al. | 123/238 |
| 4,662,329 | 5/1987 | Roggenburk | 123/236 |
| 4,815,275 | 3/1989 | Eickmann | 60/39.6 |
| 5,375,564 | 12/1994 | Gail | 123/44 C |
| 5,522,356 | 6/1996 | Palmer | 123/236 |

*Primary Examiner*—Michael Koczo
*Attorney, Agent, or Firm*—Ratner & Prestia

[57] ABSTRACT

An external combustion engine for driving a power shaft, which includes a rotary combustion chamber having an eccentric rotor and a plurality of telescoping vanes extending from the rotor to the inner walls of the combustion chamber. The vanes divide the combustion chamber into individual compression and combustion cells. As the rotor rotates the cells become progressively smaller in volume compressing a flammable mixture of fuel and air. At the point of maximum compression the mixture is ignited. The expanding gasses are permitted to escape into an adjacent expansion chamber in which rides a reciprocating piston, driving the piston and producing work.

14 Claims, 7 Drawing Sheets

INTERNAL COMBUSTION ENGINE HAVING A SEPARATE ROTARY COMBUSTION CHAMBER

BACKGROUND OF THE INVENTION

This invention relates to internal combustion engines and more particularly to an internal combustion engine having an external rotary combustion chamber venting into an associated reciprocating power cylinder.

RELATED ART

Internal combustion engines are well known today, and through a continuing evolutionary process have reached a high degree of efficiency and reliability.

Internal combustion engines may be classified into two major classes based on the type of operation, rotary and reciprocating.

The Wankel rotary engine is the best known example of the rotary type engine. Such engines typically comprise a combustion chamber within which rotates a rotor. The rotor has a power take off shaft extending outside the combustion chamber. The rotor shape is generally triangular and the three triangle apexes ride against the inner surface of the compression chamber. A proper mixture of fuel and air is injected to these cells at a point where the cell volume is the largest. As the rotor rotates and the cell volume decreases, the fuel/air mixture is compressed. Ignition is initiated at the point of maximum compression which is typically at the point where the cell volume is at a minimum.

The rotor and combustion chamber design is selected such that the force of the expanding gasses due to the ignition of the fuel is primarily in the direction of rotation of the rotor, driving the rotor. Power is obtained from the rotor shaft.

The second type of internal combustion engine is the highly successful reciprocating engine widely used in the transportation industry to date. Such engines typically comprise a plurality of stationary discreet combustion cylinders in which rides a reciprocating piston. As the piston travels in a first (traditionally referred to as the "up") direction, the cell volume in the space between the top of the piston and the cylinder decreases until the cylinder reaches the upper limit of its travel. A proper combustible mixture of fuel and air is introduced at the time when the piston is at its lowermost position. The combustible mixture is compressed as the piston travels upwardly and ignition is initiated at the point of maximum compression. The ignited combustible mixture produces an expanding volume of hot gasses which push the cylinder downwardly as they expand.

Reciprocating engines have further evolved into two more sub-categories, widely known as two cycle and four cycle. In a two cycle engine the exhausting of the spent hot gases and the intake of the combustible mixture occur during the same travel of the piston, while in the four cycle they occur in two distinct travels of the piston. Therefore the two cycle engine provides a power stroke every time the piston moves to its uppermost position while the four cycle engine provides a power stroke every other time the piston moves to its uppermost position.

Both types of engine described above have limited efficiencies which are fundamental to their design, and which are directly related to the following design limitation.

Whether the engine is a reciprocating engine or a rotary engine, when the combustion and expansion volumes are the same, one cannot recover the full potential power output of the hot combustion gas byproducts. For instance in a reciprocating engine having a ten to one compression ratio, the combustible mixture undergoes a ten to one compression ratio. The same is true for the decompression which is also limited to a ten to one volume change, since the compression volume is the same as the decompression volume. Therefore the full work output of the expanding gasses is not recaptured since as soon as the piston reaches the bottom of its travel it starts moving upwardly pushing against the still expanding hot gasses. At this time the exhaust port in the cylinder is opened, relieving the back pressure and allowing exhausting the gasses. In such apparatus energy is lost both in stopping the gas expansion and in working against the still expanding gasses in the process of expelling them.

It is an object of the present invention to provide an internal combustion engine which overcomes the above limitations and provides higher efficiency than heretofore possible.

SUMMARY OF THE INVENTION

The aforementioned object is obtained through an external combustion engine for driving a power shaft, comprising:

a) a compression and combustion chamber having a cylindrical inner surface, a central axis extending parallel to said inner surface, an intake port and a gas expansion port;

b) a rotor rotatably mounted in said chamber, said rotor having a core including a driving shaft extending parallel to said central axis and displaced therefrom, and a plurality of telescoping partitioning vanes extending radially from the core, terminating in a vane top side in sliding contact with said inner surface, c) a power cylinder in direct communication with said gas expansion port;

d) a reciprocating piston in said power cylinder;

e) a cam arrangement connected to the piston for converting a reciprocating movement of said piston in said cylinder to a rotating motion of the power shaft; and f) a rotation transmission means connected to said power shaft and to said rotor driving shaft.

It is also an object of the present invention to provide apparatus as described above which also comprises a water injection port for injecting water in the combustion chamber following ignition of the combustible mixture.

It is a further object of this invention to provide an apparatus as hereinabove described wherein ignition timing is not required for its operation.

It is yet another object of this invention to provide an external combustion engine wherein the intake and exhaust ports require no opening or closing valves.

The invention will next be described with reference to the following figures wherein same numbers are used to designate the same elements.

DETAILED DESCRIPTION OF THE INVENTION

Figure 1:
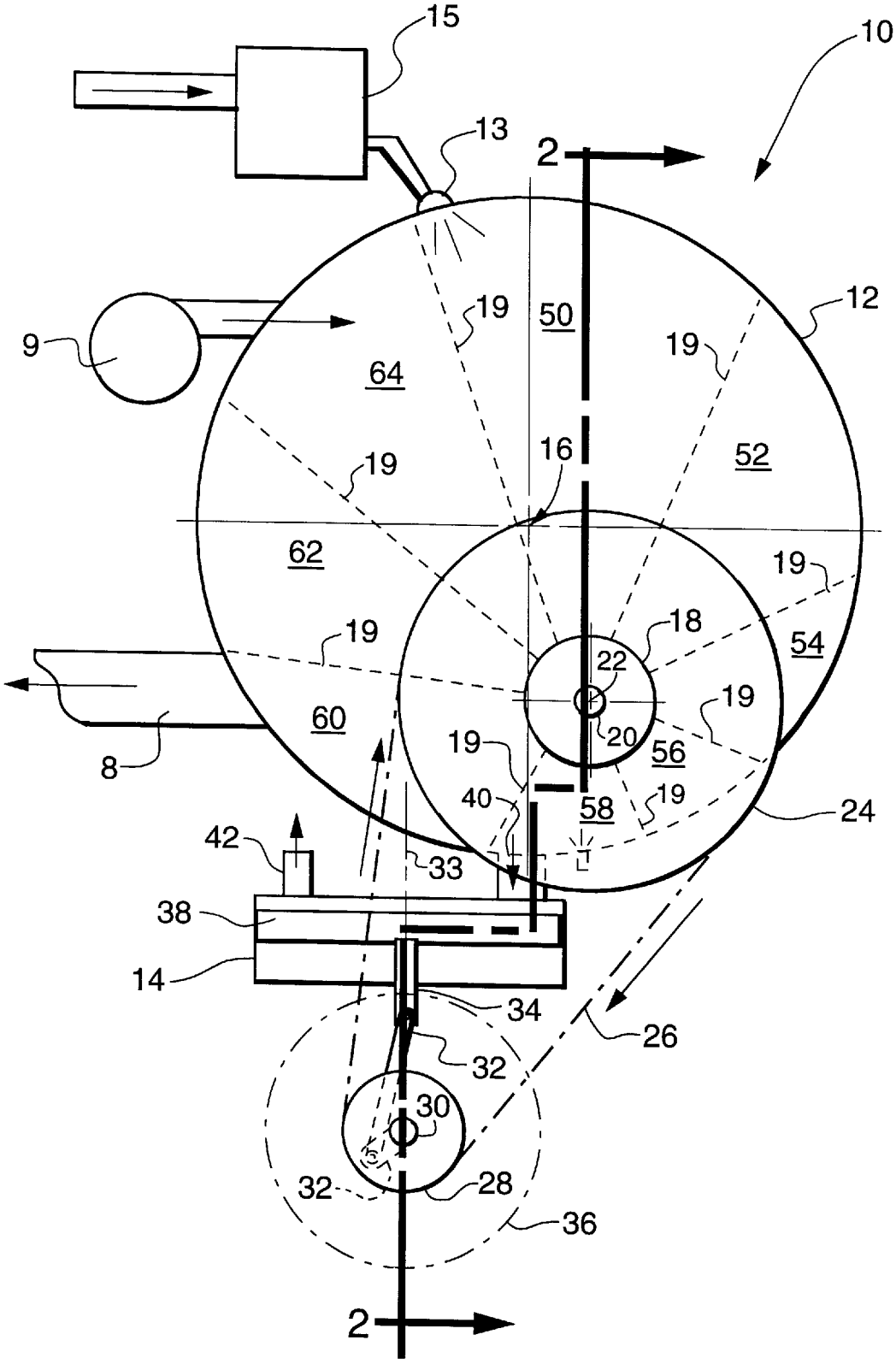
FIG. 1 is a schematic illustration of view of the front of an internal combustion engine constructed in accordance with the present invention.

The invention will next be described with reference to the figures which are schematic drawings in nature, and are provided for purposes of illustration rather than limitation. A number of simplifications and omissions are present in the drawings particularly when they relate to elements of construction such as intake and exhaust valves and ports, details of the conversion of reciprocating motion to rotary motion, flywheel mounting, mountings and supports for the combustion and power cylinders and associated elements, and such other features which, while essential for the actual assembly and use of an internal combustion engine, are elements well known in the art and where the selection of any particular such element is of no particular significance to the practice of this invention. Similarly, elements such as fuel supply piping, fuel storage tanks, and fuel injector details have also been omitted for the same reason, since their representation in the figures would unduly clutter them and would unnecessarily complicate the description and understanding of the present invention.

Figure 2:
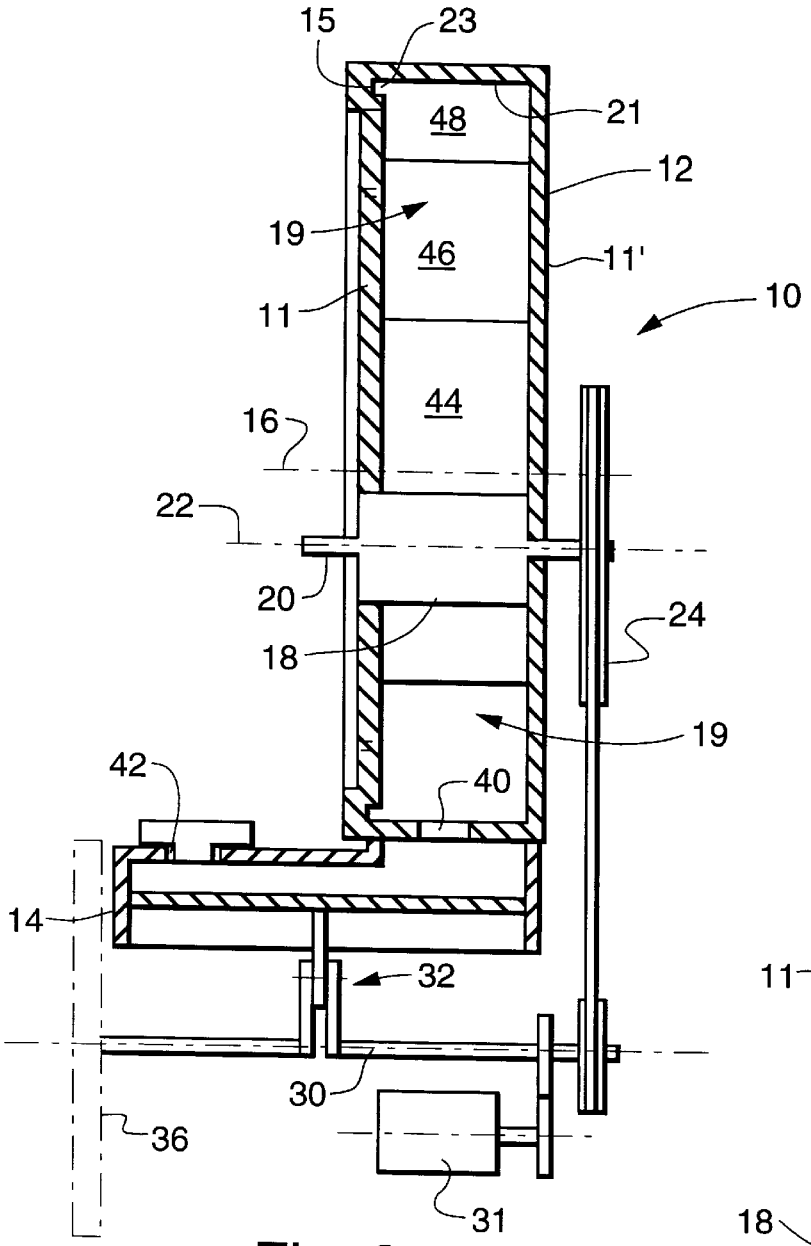
FIG. 2 is a schematic cross section view of the apparatus shown in FIG. 1 taken along line 2—2 in FIG. 1.

Referring now to FIGS. 1 and 2 there is shown an internal combustion engine 10 built according to the present invention which comprises two main parts, a combustion cylinder 12 having an axis 16, and a power cylinder 14 external to the combustion cylinder 12. Power cylinder 14 also has an axis 33 which in the preferred embodiment is perpendicular to the combustion cylinder axis 16. The power cylinder and the combustion cylinder communicate through port 40.

Within the combustion cylinder 12 there is mounted a rotor 18 on a rotor shaft 20. Rotor 18 and shaft 20 are fixedly connected and rotate together around rotor axis 22. Rotor axis 22 extends parallel to combustion cylinder axis 16, and is spaced therefrom.

We will refer often in this description to the placement of different valves, openings, injectors and other elements as being located ahead of, or following one another. These are relative locations and have been so identified relative to the direction of rotation of the rotor 18 within the combustion cylinder. For description purposes only the rotation of the rotor is assumed to be clockwise, and an element in the 12 O'clock position is located "ahead" of an element at the 3 o'clock position, while an element at 6 o'clock follows the element in the 3 o'clock position. If the rotor was rotating in a counterclockwise direction this order would be reversed. Arrows are used throughout the figures to indicate the direction of movement of different elements or the flow of fuel, gasses, water, or air.

A plurality of telescoping vanes 19 are mounted on the rotor 18 and extend from the rotor to an inner surface 21 of the combustion chamber. The vanes divide the combustion cylinder into a plurality of individual compression and combustion cells 50, 52, 54, 56, 58, 60 62 and 64 each contained between a leading and a lagging vane, the leading vane of one cell being the same as the lagging vane of the preceding cell. A fuel intake port allows the introduction of fuel in the combustion cylinder 12. The fuel intake port may include a carburetor 15 and a fuel entry valve 13 for injecting a proper fuel and air mixture into the combustion chamber. In the alternative, an air blower 9 may introduce a predetermined amount of air in the combustion cylinder. By also introducing a pre-measured amount of fuel through valve 13, the carburetor function may be performed within the combustion cylinder obviating the need for a separate carburetor.

The combustion chamber 12 also includes a first gas exhaust port 8 which serves to exhaust any gasses remaining in the chamber following ignition and combustion of the combustible mixture. The exhaust port 8 is placed following the gas expansion port 40 and is spaced therefrom sufficiently so that it does not allow any gasses to escape from a cell until they have completed their expansion into the power cylinder 14. That means that the first exhaust port 8 does not open till the lagging vane of the cell is located about halfway past the gas expansion port 40.

Mounted on the rotor shaft 20 is a rotor driving wheel 24 which is preferably a sprocket wheel with teeth sized to engage a chain drive 26.

The power cylinder 14 is preferably placed immediately adjacent to combustion cylinder 12 and as said previously, communicates with the combustion cylinder through gas expansion port 40. Within the power cylinder is a piston 38 which has rod 34 attached thereto. Piston 38 moves from a first position refer to as the "top" of cylinder 14 to a second position referred to as the "bottom" of cylinder 14 within cylinder 14. Rod 34 is also connected to a crank lever 32 in a manner to transform a reciprocating movement of the piston to a rotational movement of the power shaft 30.

The particular rod and crank arrangement is similar to what is currently employed in the traditional reciprocating cylinders of the known internal combustion engines. A flywheel 36, shown in phantom lines in FIGS. 1 and 2, may be connected to shaft 30 again as is typically done in traditional engines.

Power cylinder 14 also includes a second exhaust port 42. This port opens to allow the escape of gasses from the power cylinder. A valve 62 may be included to control the opening and closing of port 42.

A sprocket wheel 28 is mounted on the rotating power shaft 30. A chain drive 26 transmits rotational motion from wheel 28 to wheel 24, and to the rotor 18 in the combustion cylinder.

In an alternate embodiment, driving of the rotor 18 may be accomplished with a "V" belt rather than a chain, in which case the wheels 24 and 28 are grooved wheels. In yet another embodiment a timing belt may be used, in which case wheels 24 and 28 are timing gears, rather than sprocket wheels. It is also contemplated that a gear system may be used to transmit the rotational motion from the power shaft to the rotor. All such systems are well known and need no further elaboration to practice the present invention.

A starter motor 31 may be included. Such motor is of the same type and is used for the same purpose as in present automotive engines. It is typically connected so as to engage and disengage from power shaft 30, in the usual manner employed in traditional automotive engines. The starter motor is preferably electrically operated from an associated battery which is not illustrated.

Figure 3:
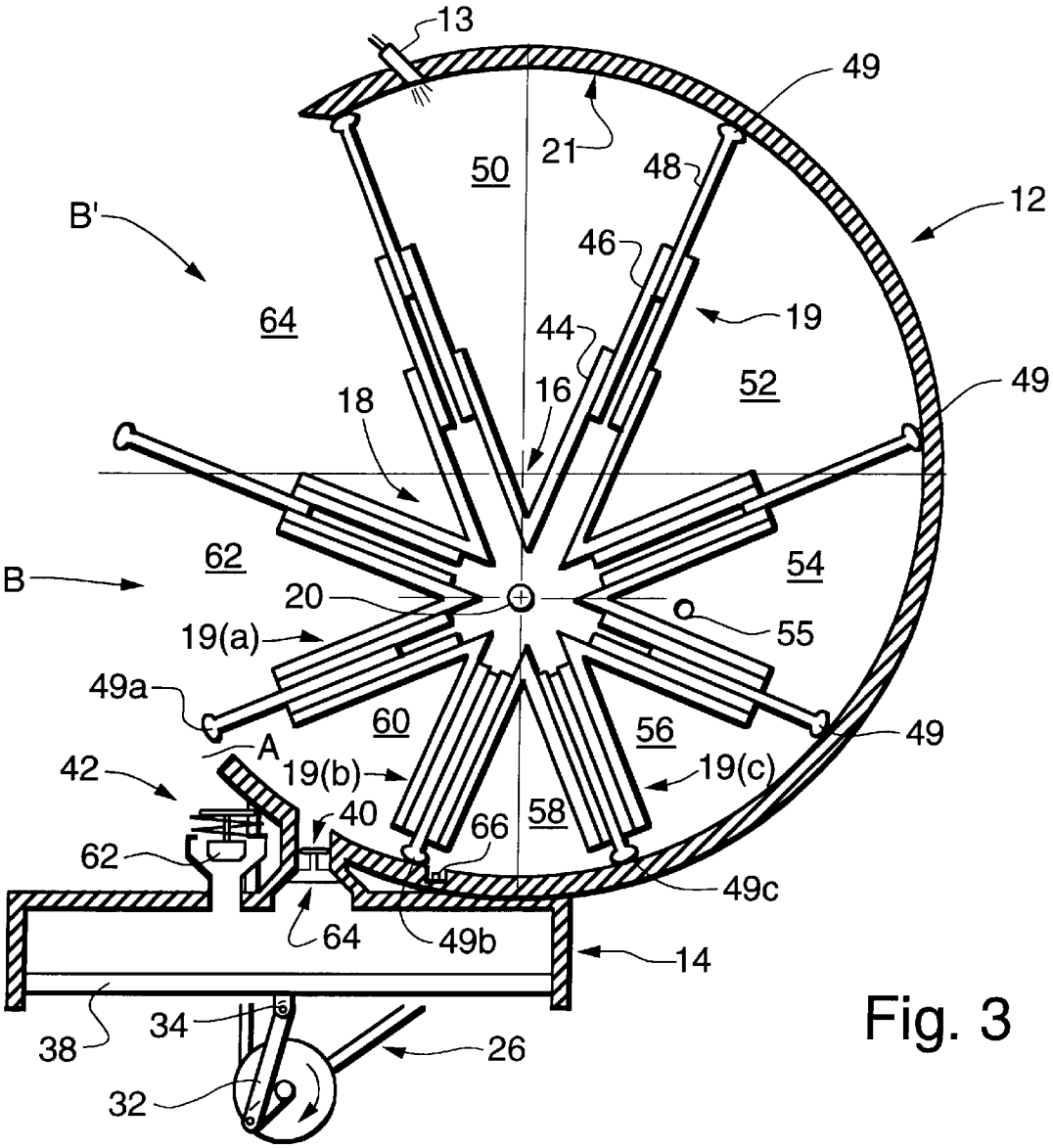
FIG. 3 is a schematic cross sectional frontal view of the apparatus illustrated in FIG. 1 showing the internal arrangement of the combustion chamber and power cylinder at a first time, just prior to ignition.

FIG. 3 shows in better detail the interior arrangement of the combustion chamber and the power cylinder at a time just prior to ignition of compressed combustible of fuel and air used in operating this internal combustion engine.

As shown in FIG. 3, rotor 18 is star shaped comprising a central core portion from which extend eight telescoping vanes 19, each vane comprising telescoping sections 44, 46 and 48 which nestle within each other. Sections 44 and 46 are hollow and preferably contain a fluid medium under pressure urging the vanes to extend outwardly from the core of the rotor. A pump not illustrated may be used to pump fluid into the a cavity in the core and vanes; in the alternative, each section may be spring-loaded. Appropriate stops are provided but not illustrated to prevent the individual vane sections from falling off the core at maximum extension.

Each vane terminates in a tip 49 which is designed to wipe the interior surface 21 of the combustion chamber forming a tight seal between the spaces on either side of the vanes. A seal is also provided along the lateral sides of the combustion chamber. This is preferably accomplished by having a wiping sliding contact strip along the vane side in contact with the combustion chamber.

With appropriate lubrication, the vanes and the vane tips may be made of steel of the type used in the piston rings of traditional reciprocating engines. Lubrication may be done by the injection of a lubricant through openings 55 placed at different positions in the combustion and compression chamber 12. A fluorocarbon material such as Teflon® may also be incorporated to the vanes along the two sides thereof and along the top tip 49 to form such a sliding seal.

The power cylinder may be constructed of any material which can withstand repeated exposure to high pressures and temperatures as would be expected in an internal combustion engine. Again steel is a good material for such purpose and has been used extensively in similar applications.

Whatever the materials selected, it is important that the vanes are able to extend and contract as the rotor rotates within the combustion chamber and that they provide a good sliding seal with the interior surface of the combustion chamber.

An alternate embodiment useful for holding the vanes at proper extension is illustrated in the schematic cross section of FIG. 2. As illustrated, the combustion chamber has two opposing side walls 11 and 13 connected to said inner surface and perpendicular thereto. At least one of said walls i.e. wall 11 includes a groove 15. Each partitioning telescopic vane top section 48 includes a tab 23 adapted to engage and ride in the groove 15 to hold the tip 49 against the circular inner surface. Such arrangement does not require either fluid or spring pressure to maintain the telescoping vanes in contact with the inside surface of the power cylinder.

Figure 2A:
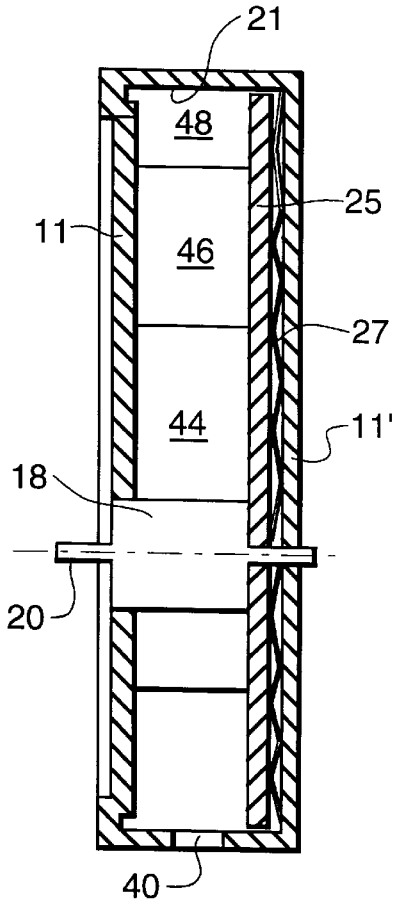
FIG. 2A is a partial schematic cross section side elevation view of another embodiment of the apparatus shown in FIG. 1.

To maintain good contact of the vanes along the side walls of the combustion chamber 12, an arrangement such as shown in FIG. 2A may be employed, wherein a second inner side wall 25 is added. This second internal side wall is spring loaded using springs 27 to urge the wall against the sides of the telescoping vanes. Springs 27 can also be replaced with a fluid under pressure to provide the resilient contact between inner side wall 25 and the sides of vanes 19.

In the embodiment of FIG. 3 the combustion chamber 12 is not a complete cylinder but only a portion thereof. Combustion chamber 12 is open on one side to the atmosphere. This is to facilitate the complete exhaustion of any residual combustion byproducts from each cell after ignition of the combustible fuel mixture and after the introduction of the hot gasses to the power cylinder. The open side also permits the introduction of air into each cell prior to the introduction of fuel.

As best seen in FIG. 3, because of the eccentricity in the location of the axis 22 of rotation of the rotor 18 relative to the axis 16 of the stationary cylindrical combustion chamber, as the rotor turns, the volume of each cell 50, 52, 54, 56, and 58 becomes progressively smaller. After reaching a minimum cell volume 58 the cells again begin getting bigger, thus cell 60 has a larger volume than cell 58, and cells 62 and 64 are of course even larger. The compression ratio in this type of chamber is defined as the ratio of the volume of cell 50 over the volume of cell 58.

An ignition device 66 which may be a spark plug, is provided in the space defined by cell 58. A standard automotive ignition system may be used to provide both the timing sequence and the power for generating a spark at the peak compression value. The timing system in this instance is, preferably, connected to the rotor shaft 20 with a timing belt. Such system has been omitted from the illustrations again because this technology is well known in the art and the present invention does not present any new or more complex timing problems that what is well known in the art of internal combustion engines.

While an ignition system with a separate timing system may be used, the present invention permits, a substantial simplification in the ignition system.

Because the individual chambers 52–64 defined by the vanes in FIG. 3 are not stationary but rotate clockwise in the embodiment illustrated, the ignition system may be constantly on, for instance a continuous electrical arc or a red hot element. The ignition element in such case is located at the point where the leading vane of the chamber in which the compression is at the highest level is just past this element. Thus as the highest compression is achieved, the leading vane moves past the ignition element exposing the compressed gasses to the element and ignition follows automatically in perfect synchronization, without need for any special timing arrangements.

Continuing the description with reference to FIG. 3, the gas expansion port 40 is located in the space occupied by cell 60. A valve 64 may be used to open and close this port. When port 40 is open, gases expand from cell 60 into the space defined between the walls of power cylinder 14 and the top of piston 38.

Figure 4:
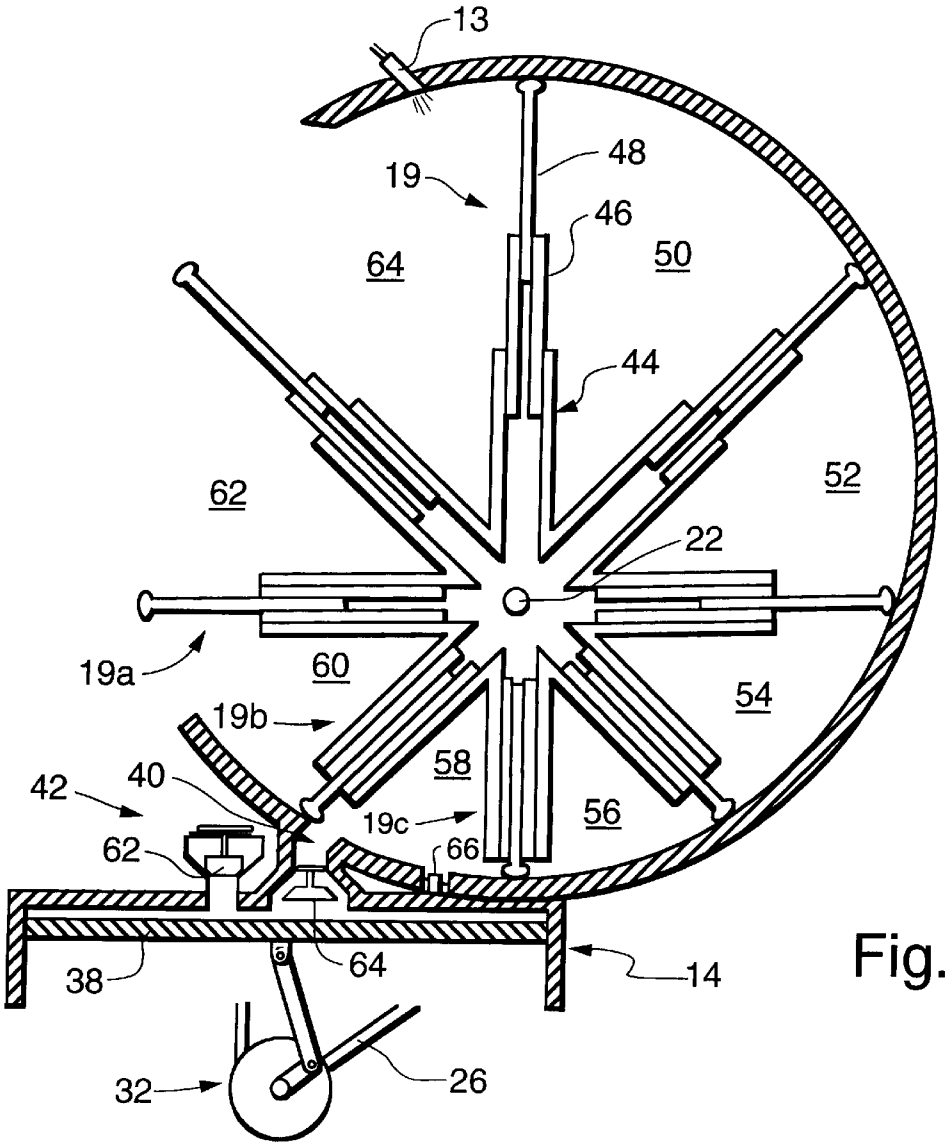
FIG. 4 is another schematic cross sectional frontal view of the apparatus illustrated in FIG. 1 showing the internal arrangement of the combustion chamber and the power cylinder at a second time, following ignition.

FIGS. 3 and 4 are used to freeze in time the rotating rotor and vanes to better explain the invention.

FIG. 3 illustrates the internal combustion engine according to the present invention at a first time. At this time, valve 64 is closed, and the piston is just beginning its upward movement from the bottom end of its travel. Also shown is the exhaust port 42 at the top of the power cylinder. An exhaust valve 62 at the exhaust port 42 is shown in the open position. Vane 19*a* is past the cylinder end and gases in cell 60 are vented to the atmosphere. Cell 58 is shown at the position approaching the maximum compression. Spark plug 66 in this illustration is idle.

As the piston moves upwardly it pushes gases from the power cylinder 14 out through exhaust port 42.

FIG. 4 shows the same internal combustion engine according to the present invention at a second time following ignition of the combustible mixture in cell 58. Piston 38 has moved to the top of cylinder 14 evacuating any residual gases from the previous cycle. The leading vane 19*b* is shown just past the port 40. Ignition has occurred only a short time earlier and the gases in cell 58 are expanding as a result of the ignition. Valve 64 has just opened allowing the expanding combustion gasses in cell 58 to expand into the power cylinder 14 forcing the piston 38 downwardly.

Because the volume of the power cylinder 14 can be made any size and is not dependent on the volume of the combustion chamber as in the traditional reciprocating internal combustion engines, the combustible mixture of fuel and air can be compressed to any desired ratio such as for instance ten to one, and the gases can decompress to another ratio such as for instance one to twenty. As a result the present engine can extract more work from the same fuel to air mixture than a traditional engine which uses the same chamber for both compression and expansion of the fuel and air mixture.

The position of valves 64 and 62 is preferably controlled with a timing belt and cam arrangement of the type used in the automotive industry for opening and closing the intake and exhaust valves of the traditional reciprocating engines. The present timing sequence opens the exhaust valve 62 as the cylinder begins its upward travel and closes the exhaust valve 62 when it reaches the top. The intake valve 64 opens when the cylinder reaches the top and remains open till the cylinder reaches the bottom of its travel, and so on.

Figure 4A:
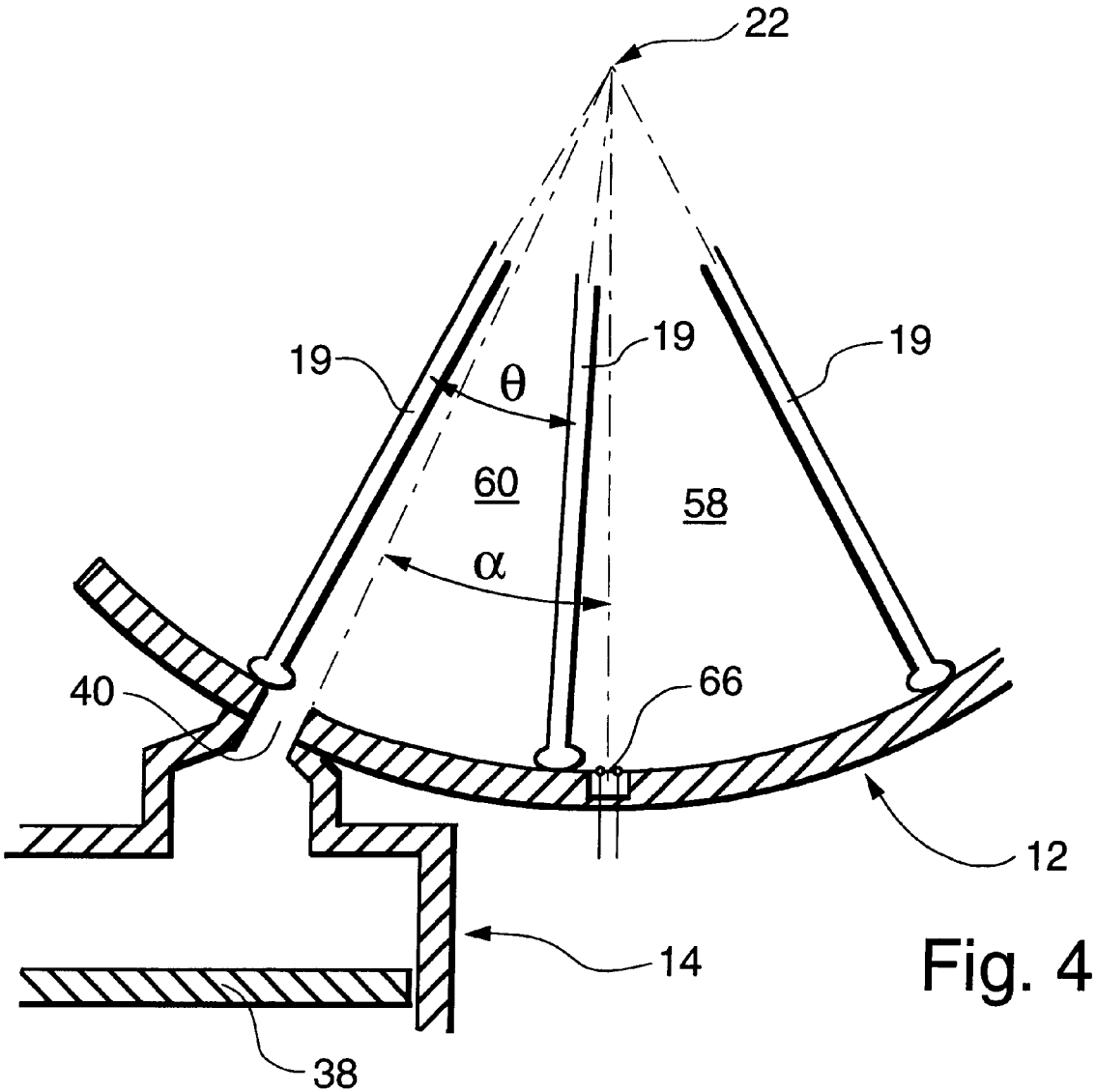
FIG. 4A is a schematic representation of a lower part of the embodiment shown in FIG. 4 wherein the gas expansion port does not include a valve.

Again it should be noted that valve 64 may also be omitted in the same manner as ignition timing may be omitted. As shown in FIG. 4A, valve 64 may be omitted by locating port 42 at a position which is uncovered by the leading vane of a chamber following ignition and complete burning of the fuel gas mixture. Care must be taken in such arrangement to place the second exhaust port which allows any residual gasses in the chamber 60 to escape, sufficiently spaced from the port 42 so as to allow complete expansion of the combustion by products into the power cylinder 14 before the chamber 60 opens to the atmosphere. This way the vanes act as the valve in opening and closing the port eliminating the need for timing mechanisms and greatly simplifying the engine operation. In this instance, an angle $\theta$ measured between two vanes is smaller than the angular distance a measured between the beginning of the gas expansion port 40 and the ignition device 66.

The process is repeated continuously for all cells as the rotor rotates bringing each cell sequentially to the ignition location and then over the gas expansion port.

As shown in FIGS. 3 and 4, as the rotor turns, cell 60 is vented to the atmosphere, or preferably to an exhaust manifold depicted in FIG. 1. Because the opening to this exhaust manifold can be made very large, any gasses remaining in the cell are substantially completely vented. Cells 62 and 64 are therefore filled with fresh air and essentially free of combustion byproducts as they approach the point where fuel will be introduced in the cells.

Figure 5:
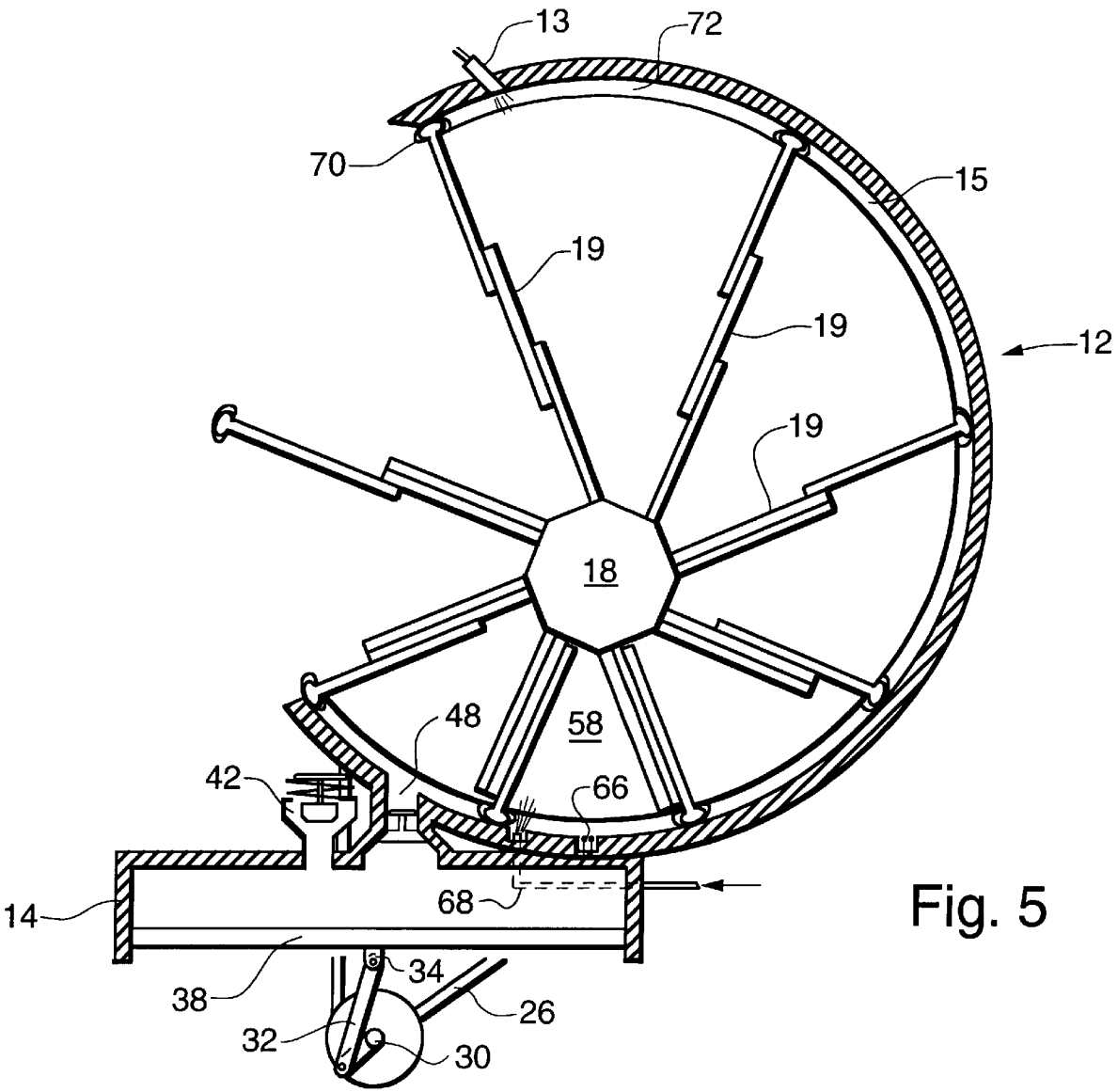
FIG. 5 is a schematic cross sectional representation of an alternate embodiment of the apparatus shown in FIG. 1 which includes a water injection port, and a different embodiment of telescoping vanes.

In yet an alternate embodiment illustrated in FIG. 5, there is provided a water injector 68 in the cell 58 which is connected through a water delivery system to a water supply (not shown). The injector 68 is used to inject water in the hot gases in the cell following ignition of the combustible mixture to generate steam which is used together with the expanding gasses to drive the piston in the power cylinder and at the same time to cool the engine.

FIG. 5 also illustrates an alternate embodiment of telescoping vanes 19 wherein the vanes are held against the inner surface of combustion chamber 12 by sliding wheels 70 which ride in a groove 72 extending along the inner side wall of combustion chamber 12 in a manner similar to the tabs riding in groove 15 shown in FIG. 2.

Figure 6:
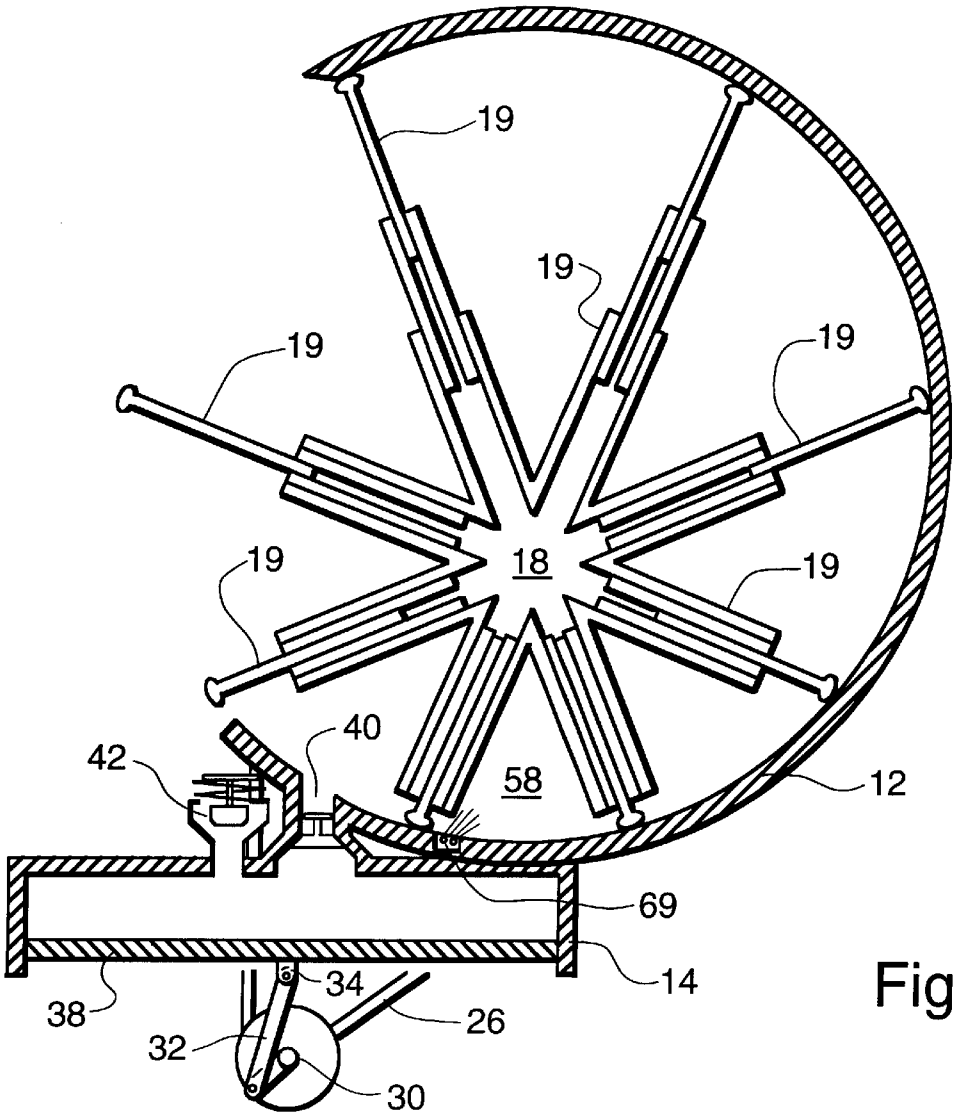
FIG. 6 is yet another schematic cross sectional representation of an alternate embodiment of the apparatus shown in FIG. 1 for use with injected diesel fuel.

FIG. 6 illustrates yet another embodiment of the present invention showing an internal combustion engine designed to operate with diesel fuel. Ignition is achieved by the timed injection of a vaporized fuel through a high pressure injector 69 into the combustion chamber at the point of highest air compression. As shown, the only difference in this embodiment of the engine according to the present invention as compared with the embodiment shown in FIG. 3, is the substitution of a fuel injection nozzle 69 for the spark plug 66 and the elimination of the fuel intake port 13. Such structure would be used in a diesel engine application where no spark plug is used for ignition.

The operation of the engine in accordance with the present invention will next be explained with reference to FIGS. 2, 3 and 4.

Initially the rotor is at rest. As is done with conventional engines, the starter motor 31 is used to rotate the rotor and begin the process of compression and ignition of the fuel air mixture.

Fuel is introduced into the first fully enclosed cell 50 which contains air scooped from the atmosphere as the rotor rotates. In the embodiment of FIG. 1 in which the combustion cylinder is a complete cylinder, air is introduced through blower 9 when the cell is in the position of cell 64. (An air filter is preferably used to assure that dust particles are not introduced in the combustion cylinder.)

As the rotor continues to rotate, the fuel to air mixture begins compressing. Eventually, cell 50 reaches the position of cell 58 in FIG. 3 which is the position of minimum volume or maximum compression. A spark is provided and the fuel air mixture in the cell ignites. As the rotor continues rotating, cell 50 now moves to the position shown in FIG. 4. Vane 19*b* moves past port 40, and valve 64 opens. The expanding gasses in cell 58 following the ignition of the fuel air mixture expand forcibly through gas expansion port 40 into power cylinder 14 pushing piston 38 downwardly to its bottom position. The reciprocating piston movement is converted to a rotary motion through the crank arrangement shown.

The energy transferred from the expanding gasses to the piston and therefrom to the rotating power shaft is now used to continue driving the rotor and to perform work.

Once ignition occurs the rotation of rotor 18 is sustained by the continuing ignition of the combustible mixture of fuel and air in the cell occupying the position of cell 58 and the subsequent expansion of the combustion gases into the power cylinder 14. The starter motor is then disengaged.

Those skilled in the art having the benefit of the present teachings as hereinabove set forth may effect numerous modifications thereto. These modifications may be construed as falling within the scope of the present invention as set forth in the appended claims in which I claim:

What is claimed is:

1. An external combustion engine for driving a power shaft, comprising:

a) a compression and combustion chamber having a cylindrical inner surface, a central axis extending parallel to said inner surface, a fuel intake port and a gas expansion port;

b) a rotor rotatably mounted in said chamber, said rotor having a core including a driving shaft extending parallel to said axis and displaced therefrom, and a plurality of telescoping partitioning vanes extending radially from the core to a vane top side in sliding contact with said surface;

c) a power cylinder in direct communication with said gas expansion port; and d) a reciprocating piston in said power cylinder;

e) wherein the fuel ignites in the compression and combustion chamber prior to passing through said gas expansion port.

2. An external combustion engine according to claim 1 further comprising:

e) a crank arrangement for converting a reciprocating movement of said piston in said cylinder to a rotating motion of the power shaft; and f) a rotation transmission means connected to said power shaft and to said rotor driving shaft.

3. An external combustion engine according to claim 1 further comprising an ignition device adjacent the gas expansion port.

4. An external combustion engine according to claim 3 wherein the rotor shaft also has an axis, and an angle $\alpha$ measured on the cylindrical inner surface between the ignition device the rotor axis and the gas expansion port is less than an angle $\theta$ between two adjacent partitioning vanes.

5. An external combustion engine according to claim 1 wherein the telescoping partitioning vanes include means for urging the vanes top sides against the inner surface.

6. An external combustion engine according to claim 3 wherein the chamber further comprises a water injection port located between the ignition device and the gas expansion port.

7. An external combustion engine according to claim 1 wherein the gas expansion port communicates with the power cylinder through a valve.

8. An external combustion engine according to claim 1 wherein the power cylinder includes a second exhaust port.

9. An external combustion engine according to claim 1 wherein the rotation transmission means comprises a first sprocket wheel on said power shaft, a second sprocket wheel on said rotor driving shaft and a chain drive connecting the two gears.

10. An external combustion engine according to claim 1 wherein the rotation transmission means comprises a belt drive.

11. An external combustion engine according to claim 10 wherein the rotation transmission belt drive comprises a timing belt.

12. An external combustion engine according to claim 1 wherein the rotation transmission means includes a flywheel.

13. An external combustion engine according to claim 1 wherein the compression and combustion chamber also has two opposing side walls connected to said inner surface perpendicular thereto at least one of said walls including a circular groove, and wherein each partitioning telescopic vane top side includes a tab adapted to engage and ride in the groove to hold the tab top sides against the circular inner surface.

14. An external combustion engine according to claim 3 wherein the ignition device is always on.

* * * * *